US010392940B2

(12) United States Patent
Mariano et al.

(10) Patent No.: US 10,392,940 B2
(45) Date of Patent: Aug. 27, 2019

(54) REMOVABLE RIVETED BALANCE RING

(71) Applicant: United Technologies Corporation, Hartford, CT (US)

(72) Inventors: Thomas Mariano, Rocky Hill, CT (US); John Berrey, Madison, VA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 703 days.

(21) Appl. No.: 14/855,876

(22) Filed: Sep. 16, 2015

(65) Prior Publication Data

US 2016/0168996 A1 Jun. 16, 2016

Related U.S. Application Data

(60) Provisional application No. 62/092,676, filed on Dec. 16, 2014.

(51) Int. Cl.

*F01D 5/02* (2006.01)
*F01D 5/30* (2006.01)
*F01D 11/00* (2006.01)

(52) U.S. Cl.

CPC ..... *F01D 5/027* (2013.01); *F01D 5/3015* (2013.01); *F01D 11/001* (2013.01); *F05D 2220/323* (2013.01)

(58) Field of Classification Search

CPC ..... F01D 5/027; F01D 5/3015; F01D 11/001; F01D 25/06

See application file for complete search history.

(56) References Cited

U.S. PATENT DOCUMENTS 4,879,792 A * 11/1989 O'Connor ..... F01D 5/027 29/889
2003/0213334 A1* 11/2003 Czerniak ..... F01D 5/027 416/145
2008/0095613 A1* 4/2008 Blanchard ..... F01D 5/027 415/140
2011/0081253 A1* 4/2011 Lecuyer ..... F01D 5/027 416/96 R
2016/0237824 A1* 8/2016 Himes ..... F04D 29/662

FOREIGN PATENT DOCUMENTS

FR 2907496 4/2008

OTHER PUBLICATIONS

Extended European Search Report dated Jul. 1, 2016 in European Application No. 15200526.0.

* cited by examiner

*Primary Examiner* — Carlos A Rivera
*Assistant Examiner* — Cameron A Corday
(74) *Attorney, Agent, or Firm* — Snell & Wilmer, L.L.P.

(57) ABSTRACT

The present disclosure includes a system for balancing a turbine disk stack, including a high pressure turbine disk stack. A flange is grooved to accommodate and orient a slip ring. Balancing weights are attached to the slip ring to balance the turbine disk stack during rotation of a gas turbine engine.

16 Claims, 3 Drawing Sheets

REMOVABLE RIVETED BALANCE RING

CROSS-REFERENCE TO RELATED APPLICATIONS

This application is a nonprovisional of, and claims priority to, and the benefit of U.S. Provisional Application No. 62/092,676, entitled "REMOVABLE RIVETED BALANCE RING," filed on Dec. 16, 2014, which is hereby incorporated by reference in its entirety.

FIELD

The present disclosure relates generally to systems for balancing rotating components and, more specifically, to systems for balancing high pressure turbine disk stacks within gas turbine engines.

BACKGROUND

Conventional gas turbine engines comprise a turbine section, such as a high pressure turbine section. For instance, the high pressure turbine section may include one or more turbine disks coupled to each other to form a disk pack. Because the disk pack rotates within the engine at high speeds, the disk pack may be rotationally balanced to reduce vibration.

Rotating components such as high pressure turbine disk stacks are typically balanced using individual balancing weights riveted to a cover that is coupled to one of the disks of the disk stack. Improved systems for balancing rotating components, such as high pressure turbine disk stacks, may be beneficial.

SUMMARY

A turbine disk balancing system in accordance with the present disclosure may include a first cover coupled to a first disk and comprising a flange having a circumferential groove, a split ring having a complimentary profile to the circumferential groove and comprising a multiplicity of axial holes, and a balance weight coupled to one of the multiplicity of axial holes of the split ring. The flange may comprise an anti-rotation tab configured to interact with an anti-rotation feature of the split ring. The first disk may be a high pressure turbine disk. A second end of the first cover may be coupled to a front mating face of the first disk. The balance weight may be riveted to the split ring through one of the multiplicity of axial holes of the split ring. The first cover may be a fore cover or an aft cover. A second cover may be coupled to a second turbine disk and have a second flange comprising second circumferential groove, and a second split ring having a complimentary profile to the second circumferential groove and comprising a multiplicity of second axial holes.

A gas turbine engine in accordance with the present disclosure may include an engine section comprising a first disk having a first cover, wherein the first cover comprises a flange having a circumferential groove, a split ring having a complimentary profile to the circumferential groove and comprising a multiplicity of axial holes, and a balance weight coupled to one of the multiplicity of axial holes of the split ring. The first cover may be a fore cover or an aft cover. The balance weight may be riveted to the split ring through one of the multiplicity of axial holes of the split ring. A second end of the first cover may be coupled to a front mating face of the first disk. The flange may comprise an anti-rotation tab configured to interact with an anti-rotation feature of the split ring. The engine section may comprise a second cover comprising a second flange having a second circumferential groove. A second split ring may have a complimentary profile to the second circumferential groove and comprising a multiplicity of second axial holes. A second balance weight may be coupled to one of the multiplicity of second axial holes of the second split ring. A first end of the second cover may be coupled to a second disk.

A method for balancing an engine section in accordance with the present disclosure may comprise providing a first disk having a first cover, wherein the first cover comprises a flange having a circumferential groove, attaching a balance weight to a split ring having a profile that is complementary to the circumferential groove by passing a rivet through a hole in the balance weight and through an axial hole of the split ring, and installing the split ring in the circumferential groove of the flange. The first cover may comprise a fore cover. The method may further comprise aligning an anti-rotation tab of the flange with an anti-rotation feature of the split ring. The engine section may comprise a second disk having a second cover comprising a second flange and a second circumferential groove. The method may further comprising attaching a second weight to a second split ring having a profile that is complementary to the second circumferential groove of by passing a rivet through a hole in the second balance weight and through an axial hole of the second split ring, and installing the second split ring in the second circumferential groove of the second flange of the second cover.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of embodiments herein makes reference to the accompanying drawings, which show embodiments by way of illustration. While these embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not for limitation. For example, any reference to singular includes plural embodiments, and any reference to more than one component or step may include a singular embodiment or step. Also, any reference to attached, fixed, connected or the like may include permanent, removable, temporary, partial, full and/or any other possible attachment option.

As used herein, "aft" refers to the direction associated with the tail of an aircraft, or generally, to the direction of exhaust of the gas turbine. As used herein, "fore" refers to the direction associated with the nose of an aircraft, or generally, to the direction of flight.

The present disclosure describes devices and systems for balancing rotating assemblies, such as high pressure turbine disk stacks, of aircraft gas turbine engines. Such systems may be utilized in new aircraft engine designs, or retrofit to existing aircraft engines. As will be described in more detail, systems comprising fore covers configured to receive weighted split rings are provided herein.

Figure 1:
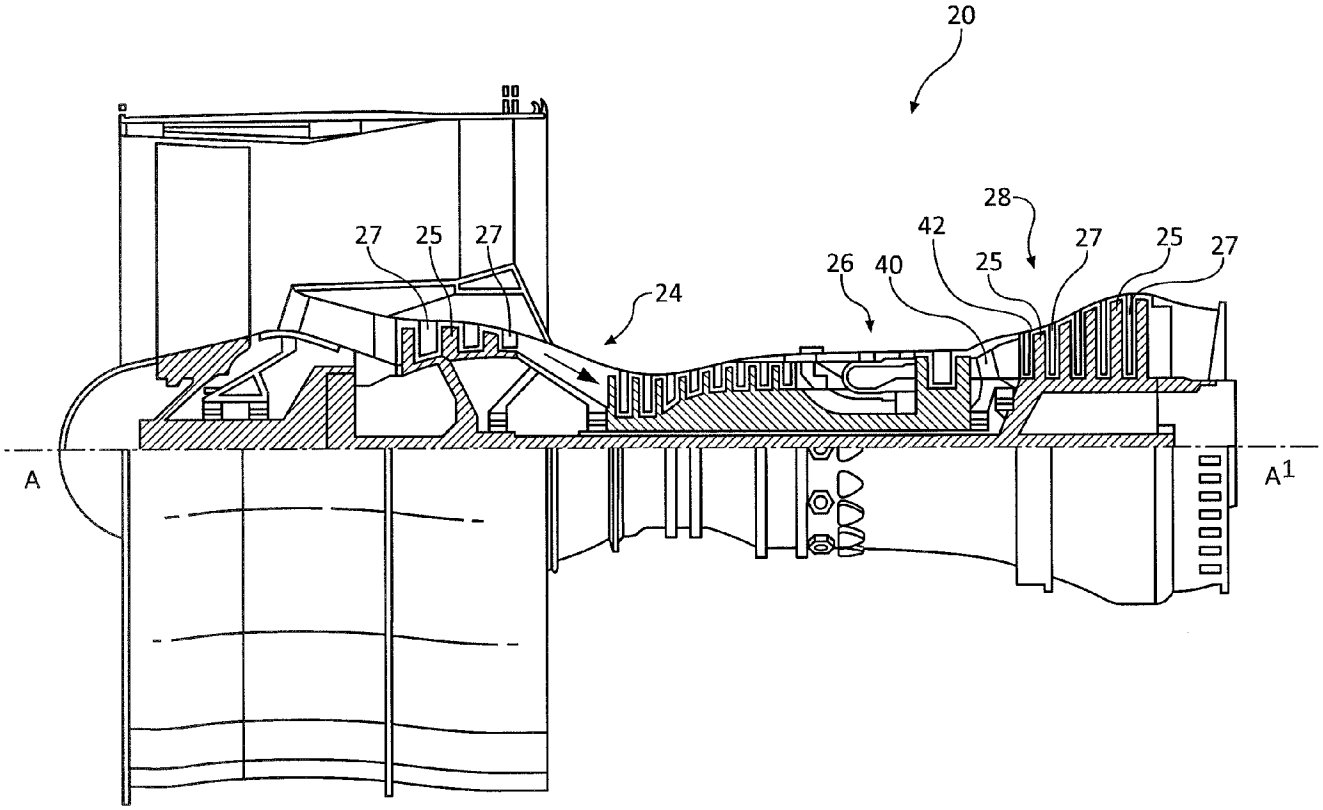
FIG. 1 illustrates a perspective view of an aircraft engine in accordance with the present disclosure.

Accordingly, with initial reference to FIG. 1, a gas turbine engine 20 is shown. In general terms, gas turbine engine 20 may comprise a compressor section 24. Air may flow through compressor section 24 and into a combustion section 26, where it is mixed with a fuel source and ignited to produce hot combustion gasses. These hot combustion gasses may drive a series of turbine blades within a turbine section 28, which in turn drive, for example, one or more compressor section blades mechanically coupled thereto.

Each of the compressor section 24 and the turbine section 28 may include alternating rows of rotor assemblies and vane assemblies (shown schematically) that carry airfoils that extend into the core flow path C. For example, the rotor assemblies may carry a plurality of rotating blades 25, while each vane assembly may carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Turbine section 28 may comprise, for example, a high pressure turbine section 40. In various embodiments, high pressure turbine section 40 may comprise a high pressure turbine (HPT) disk stack 42. HPT disk stack 42 may, for example, comprise one or more blades 25 coupled to each other and configured to rotate about axis A-A'.

Figure 2A:
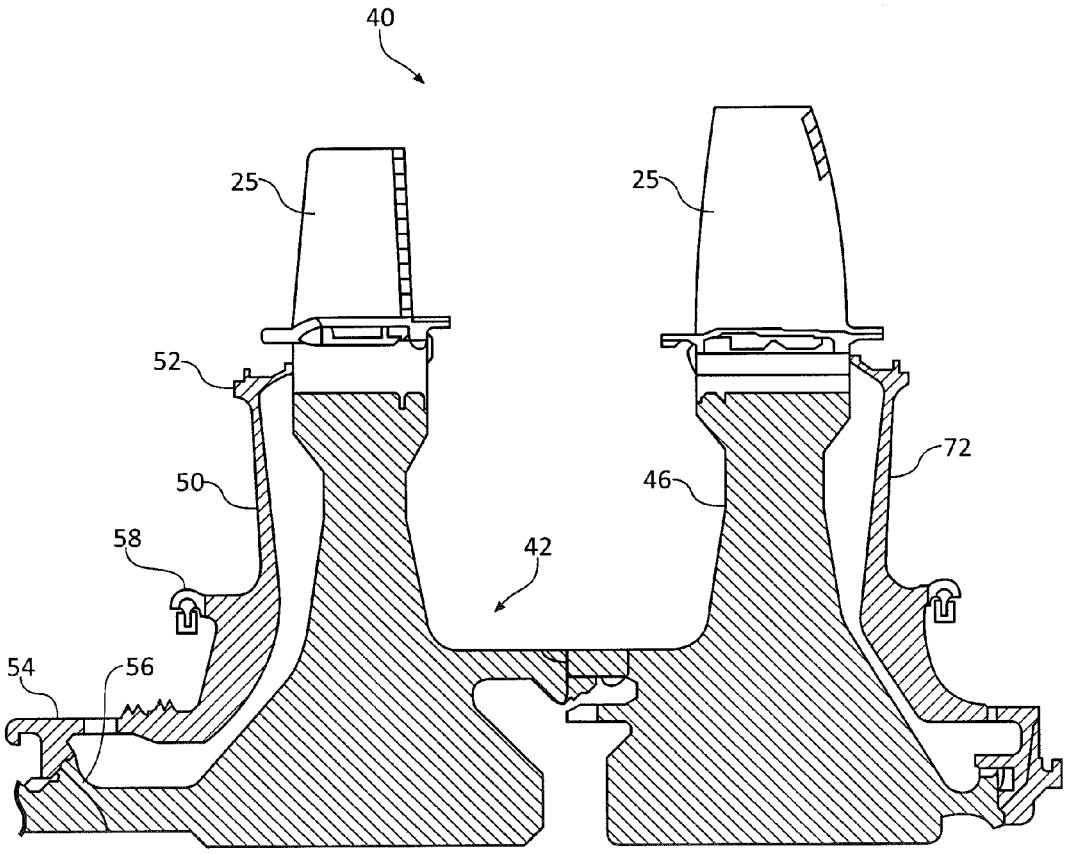
FIGS. 2A-2C illustrate cross sectional views and a front view of a turbine disk stack balance system in accordance with the present disclosure.
Figure 2B:
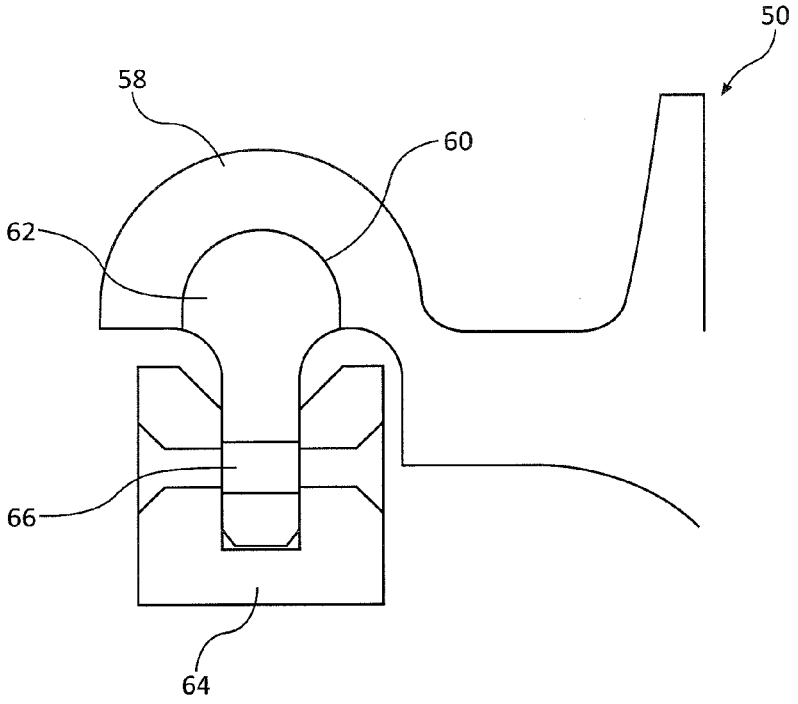
Figure 2C:
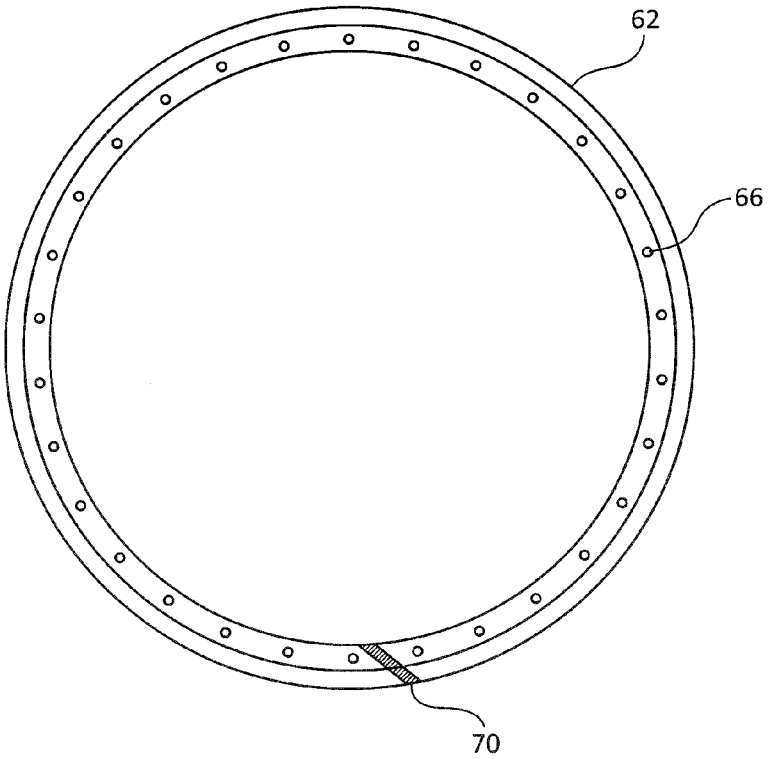

With initial reference to FIGS. 2A-2C, in various embodiments, HPT disk stack 42 comprises a first disk 44. First disk 44 may be positioned at the front of the high pressure turbine section 40, i.e., at the furthest upstream point in disk stack 42. First disk 44 may, for example, comprise one or more blades 25.

In various embodiments, HPT disk stack 42 further comprises a second disk 46. Similarly to first disk 44, second disk 46 may comprise one or more blades 25. Although described with reference to specific embodiments having a first and second disk, HPT disk stack 42 may comprise any number of disks, including a single disk.

HPT disk stack 42 may comprise a fore cover 50. For example, fore cover 50 may be coupled to first disk 44. In various embodiments, a first end 52 of fore cover 50 is coupled to first disk 44 at or near blades 25. Further, fore cover 50 may comprise a second end 54 coupled to a front mating face 56 of first disk 44.

In various embodiments, fore cover 50 is configured to provide vibrational balancing to HPT disk stack 42. A fore cover 50 in accordance with the present disclosure may comprise flange 58. In various embodiments, flange 58 comprises a circumferential groove 60. Circumferential groove 60 may comprise a groove that extends along flange 58 in the circumferential direction. In various embodiments, circumferential groove 60 is shaped and sized to receive and orient a split ring 62. In various embodiments, the split ring 62 may be a discrete split ring. For example, circumferential groove 60 may comprise a rounded groove shaped to receive split ring 62 having a rounded shape or profile that is complementary to the circumferential groove 60.

Split ring 62 may comprise, for example, a cylindrical ring made form a continuous material having a split, gap, or other point at which the ring is discontinuous. For example, split ring 62 may comprise a metal ring having a gap or split. Force may be applied to reduce the diameter of split ring 62, and upon removal of the force, the diameter of split ring 62 may increase to a resting or static diameter.

With reference to FIGS. 2A-2C, split ring 62 may comprise, for example, one or more balance weights 64. In various embodiments, balance weights 64 are coupled to split ring 62 by rivets. For example, split ring 62 may comprise one or more axial holes 66. Axial holes 66 may be positioned circumferentially along the split ring and pass through the body of split ring 62. Holes in balance weights 64 may be aligned with axial holes 66 and a rivet passed through both holes axially. The coupling of balance weights 64 to split ring 62 may be performed outside of gas turbine engine 20. For example, a technician may couple balance weights 64 to split ring 62 on a balancing machine, then transport the properly weighted split ring 62 to gas turbine engine 20 for installation.

In various embodiments, circumferential flange 58 may further comprise an anti-rotation tab 68. For example, anti-rotation tab 68 may be positioned within or outside of circumferential groove 60. In various embodiments, anti-rotation tab 68 may align with a complementary anti-rotation feature 70 of split ring 62 to secure the orientation of split ring 62 relative to circumferential flange 58 within circumferential groove 60 during operation of gas turbine engine 20.

HPT disk stack 42 may further comprise an aft cover 72. In various embodiments, aft cover 72 is coupled to a turbine disk such as, for example, second disk 46. Aft cover 72 may also be configured to balance HPT disk stack 42. For example, aft cover 72 may comprise the same features as fore cover 50 (e.g., flange 58, circumferential groove 60, split ring 62, balance weights 64) which function to balance HPT disk stack 42. Although described with reference to particular embodiments, aft cover 72 may be coupled to any disk, including first disk 44, aft of, for example, fore cover 50.

In various embodiments, HPT disk stack 42 comprises both a fore cover 50 and an aft cover 72. In various embodiments HPT disk stack 42 comprises only a fore cover 50. In yet further embodiments, HPT disk stack 42 comprises only an aft cover 72. Stated another way, any combination of fore cover 50 and aft cover 72 is within the scope of the present disclosure.

It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A gas turbine engine disk balancing system comprising:

a first cover coupled to a first disk and comprising a flange having a circumferential groove comprising a rounded groove shape;

a discrete split ring having a rounded profile that is complementary to the circumferential groove and comprising an axial hole; and a balance weight coupled to the axial hole of the discrete split ring, wherein the balance weight is riveted to the discrete split ring through the axial hole of the discrete split ring.

2. The gas turbine engine disk balancing system of claim 1, wherein the first cover is a fore cover and the first disk is a fore disk.

3. The gas turbine engine disk balancing system of claim 1, wherein the first cover is an aft cover and the first disk is an aft disk.

4. The gas turbine engine disk balancing system of claim 1, wherein the first disk is a high pressure turbine disk.

5. The gas turbine engine disk balancing system of claim 1, wherein a second end of the first cover is coupled to a front mating face of the first disk.

6. The gas turbine engine disk balancing system of claim 1, further comprising a second balance weight riveted to the discrete split ring through a second axial hole of the discrete split ring.

7. A gas turbine engine comprising:

an engine section comprising one of a high pressure turbine section, a low pressure turbine section, a high pressure compressor section, or a low pressure compressor section, wherein the engine section comprises a first disk having a first cover, wherein the first cover comprises a flange having a circumferential groove comprising a rounded groove;

a discrete split ring having a complimentary rounded profile to the circumferential groove and comprising an axial hole; and a balance weight coupled to the axial hole of the discrete split ring, wherein the balance weight is riveted to the discrete split ring through the axial hole of the discrete split ring.

8. The gas turbine engine of claim 7, wherein the first cover is a fore cover.

9. The gas turbine engine of claim 8, wherein a second end of the fore cover is coupled to a front mating face of the first disk.

10. The gas turbine engine of claim 8, wherein the engine section further comprises an aft cover comprising an aft flange having an aft circumferential groove, an aft discrete split ring comprising an axial hole, and an aft balance weight coupled to the axial hole of the aft discrete split ring.

11. The gas turbine engine of claim 10, wherein a first end of the aft cover is coupled to a second high pressure turbine disk.

12. The gas turbine engine of claim 7, wherein the balance weight is riveted to the split through the axial hole of the discrete split ring.

13. A method for balancing an engine section comprising:

providing a first disk having a first cover, wherein the first cover comprises a flange having a circumferential groove comprising a rounded groove;

attaching a balance weight to a discrete split ring having a rounded profile that is complementary to the circumferential groove by passing a rivet through a hole in the balance weight and through an axial hole of the discrete split ring; and installing the discrete split ring in the circumferential groove of the flange.

14. The method of claim 13, wherein the first cover comprises a fore cover.

15. The method of claim 13, wherein the engine section comprises a second disk having a second cover comprising a second flange and a second circumferential groove.

16. The method of claim 15, further comprising attaching a second weight to a second discrete split ring having a profile that is complementary to the second circumferential groove of by passing a rivet through a hole in the second balance weight and through an axial hole of the second discrete split ring, and installing the second discrete split ring in the second circumferential groove of the second flange of the second cover.

* * * * *